US007695610B2

(12) United States Patent
Bolshakov et al.

(10) Patent No.: US 7,695,610 B2
(45) Date of Patent: Apr. 13, 2010

(54) LIGHT FUEL OIL

(75) Inventors: Valentin Filippovich Bolshakov, St. Petersburg (RU); Aleksandr Valentinovich Bolshakov, St. Petersburg (RU); Tamara Nikitovna Mitusova, Moscow (RU); Sergey Olegovich Shinkov, Moscow (RU); Tatiana Felikosovna Ovchinnikova, Yaroslav (RU)

(73) Assignee: Oiltreid Limited Liabilities Company, Moscow (RU)

( * ) Notice: Subject to any disclaimer, the term of this patent is extended or adjusted under 35 U.S.C. 154(b) by 54 days.

(21) Appl. No.: 11/816,098

(22) PCT Filed: Jul. 13, 2006

(86) PCT No.: PCT/RU2006/000376

§ 371 (c)(1),
(2), (4) Date: Aug. 10, 2007

(87) PCT Pub. No.: WO2007/011263

PCT Pub. Date: Jan. 25, 2007

(65) Prior Publication Data

US 2008/0210595 A1 Sep. 4, 2008

(30) Foreign Application Priority Data

Jul. 18, 2005 (RU) ..... 2005122579

(51) Int. Cl.
*C10L 1/00* (2006.01)
*C10L 1/04* (2006.01)
*C10L 1/10* (2006.01)
*C10L 1/16* (2006.01)

(52) U.S. Cl. ..... 208/15; 208/13; 208/14; 585/14; 44/300

(58) Field of Classification Search ..... 208/13–15; 44/300; 585/14
See application file for complete search history.

(56) References Cited

U.S. PATENT DOCUMENTS

| | | | | |
|---|---|---|---|---|
| 2,687,991 | A | 8/1954 | Miller | |
| 3,792,984 | A | 2/1974 | Cole et al. | |
| 4,127,138 | A | 11/1978 | Sweeney | |
| 4,263,128 | A | 4/1981 | Bartholic | |
| 4,441,890 | A | 4/1984 | Feldman | |
| 4,504,377 | A | 3/1985 | Shu et al. | |
| 4,513,155 | A * | 4/1985 | Tamura et al. | 585/13 |
| 4,746,328 | A | 5/1988 | Sakamoto et al. | |
| 5,362,375 | A | 11/1994 | Kubo et al. | |
| 5,593,463 | A | 1/1997 | Gambini et al. | |
| 5,885,444 | A | 3/1999 | Wansbrough et al. | |
| 5,917,101 | A | 6/1999 | Munoz | |
| 6,056,793 | A | 5/2000 | Suppes | |
| 6,136,049 | A | 10/2000 | Nakajima et al. | |
| 6,215,034 | B1 | 4/2001 | Oomori et al. | |
| 6,265,629 | B1 | 7/2001 | Fava et al. | |
| 6,291,732 | B2 | 9/2001 | Hubbard et al. | |
| 6,534,453 | B2 | 3/2003 | Omori et al. | |
| 6,776,897 | B2 | 8/2004 | Bacha et al. | |
| 6,846,402 | B2 | 1/2005 | Hemighaus et al. | |
| 6,972,084 | B1 | 12/2005 | Nakashima et al. | |
| 7,033,484 | B2 | 4/2006 | Bacha et al. | |
| 2003/0136047 | A1 | 7/2003 | Ketley et al. | |
| 2005/0040072 | A1 | 2/2005 | Respini et al. | |
| 2006/0122442 | A1 | 6/2006 | Kohler et al. | |

FOREIGN PATENT DOCUMENTS

| | | | |
|---|---|---|---|
| EP | 0338311 | A1 | 10/1989 |
| EP | 1230325 | A1 | 8/2002 |
| GB | 187351 | A | 10/1922 |
| JP | 63030594 | A | 2/1988 |
| JP | 8259966 | A | 10/1996 |
| JP | 8311462 | A | 11/1996 |
| JP | 2001019977 | A | 1/2001 |
| JP | 2001019978 | A | 1/2001 |
| RU | 1672731 | C | 5/1995 |
| RU | 2076138 | C1 * | 3/1997 |
| RU | 2126437 | C1 * | 2/1999 |
| RU | 2155211 | C1 * | 8/2000 |
| WO | WO 2005005580 | A1 * | 1/2005 |

OTHER PUBLICATIONS

Primary and Secondary Distillates as Marine Fuel Oil, Mitusova, Pugach, et al. Chemistry and Technology of Fuels and Oils vol. 41 No. 4 2005.*
http://www.fwc.com/industries/pdf/VisbreakingProcess.pdf; Oct. 11, 2007.
http://science.howstuffworks.com/oil-refining2.htm; Oct. 11, 2007.
http://www.cedre.fr/fr/publication/coll/vhfo/jezequel.pdf; Oct. 11, 2007.
http://www.solublesolutions.com/ResTutorial.html; Oct. 11, 2007.
http://www.pseg.com/customer/business/industrial/convert/cost.jsp; Oct. 11, 2007.

(Continued)

*Primary Examiner*—Glenn A Caldarola
*Assistant Examiner*—Pamela Weiss
(74) *Attorney, Agent, or Firm*—Panitch Schwarze Belisario & Nadel LLP

(57) ABSTRACT

The invention relates to oil refining, more particularly to a composition of a light fuel oil for use in medium-speed diesel engines of marine power units. The inventive light fuel oil comprises, in % by wt.: black oil—(4-10), tar—(2-10), light catalytic cracking gas oil—(10-30), heavy catalytic cracking gas oil—(5-10), a straight-run diesel fuel—(8-10), a viscosity breaking residuum of a heavy oil fraction—the rest. The selected component ratio will enable to improve the fuel stability in transportation and storage, expand the range of available fuels and increase the production volumes of quality fuels, while rationally using poor-quality products readily available at refineries.

6 Claims, No Drawings

OTHER PUBLICATIONS http://tonto.eia.doe.gov/dnav/pet/TblDefs/pet_pnp_pct_tbldef2.asp; Oct. 11, 2007.
http://www.dnv.com/industry/maritime/servicessolutions/fueltesting/fuelqualitytes ting/iso8217fuelstandard.asp; Oct. 4, 2007.
http://www.aehs.com/publications/catalog/contents/Volume2.pdf; Oct. 11, 2007.
http://www.uop.com/objects/28%20%20Visbreaking.pdf; Oct. 11, 2007.
http://www.engineeringtoolbox.com/classification-gas-oil-d_165.html; Oct. 11, 2007.
http://www.bunkerworld.com/; Oct. 5, 2007.
http://web.archive.org/web/20061017124821/www.fammllc.com/famm/publications/famm_fuels_book.pdf; Oct. 11, 2007.
http://www.globalsecurity.org/military/systems/ship/systems/fuel-oil.htm; Oct. 5, 2007.
http://www.p2pays.org/ref/07/06026.htm#7; Oct. 11, 2007.
http://web.archive.org/web/20070817165132/http://energyconcepts.tripod.com/energyconcepts/heavy_oil.htm; Oct. 11, 2007.
http://www.fwc.com/industries/pdf/Residue_upgrading_English_10th_Sept.pdf ; Oct. 11, 2007.
http://www.dnv.com/maritime/fueltesting/fuelqualitytesting/ISO8217.asphttp://www.valero.com/NR/rdonlyres/18D1EE0F-7CB7-4985-9F47-84976F2E65C5/0/BunkerFuel200.pdf; Oct. 11, 2007.
http://www.valero.com/NR/rdonlyres/2578AEAC-C1EC-4E5C-94EA325E9 FDE6287/0/No6FuelOil203.pdf; Oct. 11, 2007.
A copy of International Preliminary Report on Patentability for the corresponding International Patent Application No. PCT/RU2006/000376; issued Mar. 11, 2008; 5.

* cited by examiner

LIGHT FUEL OIL

This application is a national phase application of International Application No. PCT/RU2006/000376, international filing date Jul. 13, 2006 which claims priority to Patent Application of Russian Federation No. 2005122579, filed Jul. 18, 2005. These documents are hereby incorporated by reference in their entirety.

BACKGROUND OF THE INVENTION

This invention relates to oil processing and, more particularly, to a composition of a fuel oil, such as light fuel oil that may be used in medium-speed diesel engines of marine power systems.

A light fuel oil may be produced from straight-run distillate and residuum as well as from products of secondary origin and mixtures thereof.

A marine fuel oil is known, as disclosed in *Chemistry and Technology of Fuels and Oils,* 1978, #3, p. 28-30, which comprises 36-42% by wt. of straight-run black oil, 42-48% by wt. of straight-run diesel fuel, and 10-22% by wt. of a coker gas oil or catalytic cracking gas oil.

However, this fuel is characterized, for example, by unstable pour-point temperatures during storage and comprises high quantities of valuable distillate fractions—up to 70% by wt.

A fuel for marine power systems is also known, as disclosed in RU 2155211, C 10 L 1/04, 2000, which comprises 5-30% by wt. of tar oil, up to 25% by wt. of long vacuum residuum 260-510° C., or products of topped residuum and long vacuum residuum 260-510° C., 20-25% by wt. of light catalytic cracking gas oil, 15-40% by wt. of hydrofined diesel fuel, up to 0.05% by wt. of a pour-point depressant, and black oil forming the rest.

However, the high content (up to 40% by wt.) of hydrofined diesel fuel, as well as the need for straight-run black oil, may for example, place certain limitations on its production, such as cost of production and availability of components.

Another marine fuel oil is also known, as disclosed in RU 2139912, C 10 L 1/04, 1/18, 1999, which comprises in percent by wt.:

| | |
|---|---|
| Tar | 10-15 |
| Light catalytic cracking gas oil | 15-30 |
| Heavy catalytic cracking gas oil | 10-20 |
| Hydrofined diesel fuel | 19-30 |
| Black oil | the rest |

However, this fuel composition may not be sufficiently stable, which results in stratification of the marine fuel during transportation and storage; further, this fuel comprises significant quantities of hydrofined diesel fuel and straight-run black oil.

SUMMARY OF THE INVENTION

The fuel disclosed herein may have improved stability, expands the range of available fuels, and increase the production volumes of quality fuels.

Additional objects and advantages of the invention will be set forth in part in the description which follows. The objects and advantages of the invention will be realized and attained by means of the elements and combinations particularly pointed out in the appended claims.

DETAILED DESCRIPTION OF THE INVENTION

This description discloses a light fuel oil comprising, in percent by wt.:

| | |
|---|---|
| Fuel oil residuum | 4-10 |
| Tar | 2-10 |
| Light catalytic cracking gas oil | 10-30 |
| Heavy catalytic cracking gas oil | 5-10 |
| Straight-run diesel fuel | 8-10 |
| Residue from viscosity breaking of a heavy oil fraction | the rest. |

In one embodiment of the present disclosure, the fuel may comprise up to 5% by wt. of light coker gas oil and 0.02-0.1% by wt. of a pour-point depressant based on copolymers of ethylene and vinyl acetate.

In another embodiment, the fuel composition of the present disclosure may be replaced to the maximum by residual products of deep oil processing, instead of fuel oil residuum. In yet another embodiment, the fuel composition may comprise straight-run diesel fuel, instead of hydrofined diesel fuel.

The selected component ratios disclosed herein may, for example, result in improved fuel stability in transportation and storage, expand the range of available fuels and/or increase the production volumes of quality fuels while using lower-quality or lower value products readily available at refineries.

Five samples of the fuel composition disclosed herein was produced by mixing components by agitation.

The characteristics of the components included into the fuel composition are shown in Table 1. In one embodiment, the fuel may comprise, as its basis, a residuum of tar viscosity breaking or a mixture of tar and black oil.

The compositions of the prepared specimens and their quality parameters are shown in Table 2.

As the data of Table 2 show, the fuel specimens produced by in those embodiments fully comply with the GOST standards for fuels for marine power systems.

It is intended that the specification and examples be considered as exemplary only, with a true scope and spirit of the invention being indicated by the following claims.

TABLE 1

CHARACTERISTICS OF THE COMPONENTS USED FOR PREPARING SPECIMENS OF THE INVENTIVE LIGHT FUEL OIL

| Item | PARAMETERS | Residuum of tar viscosity breaking | Light catalytic cracking gas oil | Heavy catalytic cracking gas oil | Straight-run diesel fuel | Tar | Black oil | Light coker gas oil |
|---|---|---|---|---|---|---|---|---|
| 1. | Pour point, ° C. | 10 | −12 | 16 | −13 | 30 | 21 | 2 |
| 2. | Conditional viscosity at: | | | | | | | |
| | 80° C. | 6.6 | 1.20[x] | 2.30[x] | 1.32[xx] | 42.1 | 8.0 | 2.5 |
| | 100° C. | 3.4 | — | — | — | 16.2 | 3.93 | 1.84 |

TABLE 1-continued

CHARACTERISTICS OF THE COMPONENTS USED FOR PREPARING SPECIMENS OF THE INVENTIVE LIGHT FUEL OIL

| Item | PARAMETERS | Residuum of tar viscosity breaking | Light catalytic cracking gas oil | Heavy catalytic cracking gas oil | Straight-run diesel fuel | Tar | Black oil | Light coker gas oil |
|---|---|---|---|---|---|---|---|---|
| 3. | Kinematic viscosity, $mm^2/sec$ at: | | | | | | | |
| | 80° C., | 50.2 | 2.7[x] | 14.8[x] | 4.10[xx] | 320 | 60.5 | 15.7 |
| | 100° C. | 29.7 | — | — | — | 122.0 | 29.0 | 9.92 |
| 4. | Mass fraction of sulfur, % | 2.6 | 1.20 | 2.32 | 0.75 | 2.56 | 1.7 | 2.0 |
| | Coking ability, % | 12.1 | 0.02 | 0.38 | 0.008 | 10.2 | 7.3 | 0.5 |

[x]= at 50° C.;
[xx]= at 20° C.

TABLE 2

COMPOSITIONS OF THE SPECIMENS OF THE INVENTIVE LIGHT FUEL OIL AND THEIR QUALITY INDICES

| Item | | Component content, in % by wt. | | | | |
|---|---|---|---|---|---|---|
| | | Specimen 1 | Specimen 2 | Specimen 3 | Specimen 4 | Specimen 5 |
| | COMPONENTS | | | | | |
| 1. | Light catalytic cracking gas oil | 30 | 20 | 10 | 15 | 22 |
| 2. | Heavy catalytic cracking gas oil | 10 | 15 | 5 | 6 | 10 |
| 3. | Straight-run diesel fuel | 10 | 8 | 20 | 15 | 13 |
| 4. | Tar | 5 | 2 | 3 | 10 | 2 |
| 5. | Fuel oil residuum | 5 | 10 | 4 | 4 | 10 |
| 6. | Light coker gas oil | 3 | — | — | — | 5 |
| 7. | Pour-point depressant | | | | 0.1 | |
| 8. | Residue from viscosity breaking of a heavy oil | The rest | The rest | The rest | The rest | The rest |
| | QUALITY INDICES | VALUES | | | | |
| 1. | Conditional viscosity at 50° C., CV degrees | 3.80 | 4.62 | 4.80 | 4.76 | 3.71 |
| 2. | Kinematic viscosity at 50° C., mm/sec | 27.6 | 34.1 | 36.4 | 35.0 | 27.0 |
| 3. | Pour point, ° C. | −6 | +2 | +6 | −3 | −4 |
| 4. | Mass fraction of sulfur, % | 1.90 | 2.04 | 2.07 | 2.05 | 1.91 |
| 5. | Stability: | | | | | |
| | spot | 1 | 2 | 2 | 2 | 1 |
| | total residue at chemical ageing, % | 0.02 | 0.06 | 0.09 | 0.05 | 0.05 |

The invention claimed is:

1. A light fuel oil comprising the following components by weight percent ratio:

| | |
|---|---|
| Fuel oil residuum | 4-10; |
| Tar | 2-10; |
| Light catalytic cracking gas-oil | 10-30; |
| Heavy catalytic cracking gas-oil | 5-10; |

-continued

| | |
|---|---|
| Straight -run diesel fuel | 8-10; and |
| Residue from viscosity breaking of a heavy oil fraction | the rest. |

2. The light fuel oil according to claim 1, further comprising up to 5% by weight of light coker gas oil.

3. The light fuel oil according to claim 1, further comprising a pour-point depressant comprising ethylene and vinyl acetate copolymers in an amount from 0.02% to 0.1% by wt.

4. A light fuel oil consisting essentially of the following components by weight percent ratio:

| | |
|---|---|
| Fuel oil residuum | 4-10; |
| Tar | 2-10; |
| Light catalytic cracking gas oil | 10-30; |
| Heavy catalytic cracking gas oil | 5-10; |
| Straight-run diesel fuel | 8-10; and |
| Residue from viscosity breaking of a heavy oil fraction | the rest. |

5. A light fuel oil consisting essentially of the following components by weight percent ratio:

| | |
|---|---|
| Fuel oil residuum | 4-10; |
| Tar | 2-10; |
| Light catalytic cracking gas oil | 10-30; |

-continued

| | |
|---|---|
| Heavy catalytic cracking gas oil | 5-10; |
| Straight-run diesel fuel | 8-10; |
| Light coker gas oil | up to 5; and |
| Residue from viscosity breaking of a heavy oil fraction | the rest. |

6. A light fuel oil consisting essentially of the following components by weight percent ratio:

| | |
|---|---|
| Fuel oil residuum | 4-10; |
| Tar | 2-10; |
| Light catalytic cracking gas oil | 10-30; |
| Heavy catalytic cracking gas oil | 5-10; |
| Straight-run diesel fuel | 8-10; |
| Pour-point depressant comprising ethylene and vinyl acetate copolymers | 0.02 to 0.1; and |
| Residue from viscosity breaking of a heavy oil fraction | the rest. |

* * * * *